US005285952A

United States Patent [19]

Ho

[11] Patent Number: 5,285,952

[45] Date of Patent: Feb. 15, 1994

[54] DOCUMENT FOLDER

[76] Inventor: Chen-Lien Ho, No. 36, Lo-Yang Rd., Hsi-Tun Dist., Taichung City, Taiwan

[21] Appl. No.: 1,357

[22] Filed: Jan. 7, 1993

[51] Int. Cl.[5] ..... B42D 3/10

[52] U.S. Cl. ..... 229/1.5 R; 281/28; 281/45

[58] Field of Search ..... 229/1.5 R, 92, 92.5, 229/DIG. 4; 281/45, 28, 21.1

[56] References Cited

U.S. PATENT DOCUMENTS

| | | | |
|---|---|---|---|
| 2,883,989 | 4/1959 | Ulrich, Jr. | 229/1.5 R |
| 3,779,393 | 12/1973 | Grundell | 229/1.5 R |
| 4,904,104 | 2/1990 | Gloeckie | 281/45 |
| 5,226,676 | 7/1993 | Su | 281/45 |

*Primary Examiner*—Joseph Man-Fu Moy
*Attorney, Agent, or Firm*—Panitch Schwarze Jacobs & Nadel

[57] ABSTRACT

A document folder includes an upper sheet, a lower sheet and an elongated folding portion which interconnects the upper and lower sheets. A generally C-shaped clamp has an upper clamping plate, a lower clamping plate and a curved portion which interconnects the upper and lower clamping plates. Two protrusions extend oppositely from the free edge of the lower clamping plate. Two parallel slits are formed in the lower sheet of the document folder adjacent to the folding portion of the document folder. The protrusions of the lower clamping plate of the C-shaped clamp are slidably and respectively received in the slits 3 Claims, 3 Drawing Sheets

DOCUMENT FOLDER

BACKGROUND OF THE INVENTION

1. Field of the Invention

This invention relates to a document folder, more particularly to a document folder which has a clamp to clamp the documents, papers, etc. that are received in the document folder.

2. Description of the Related Art

In the prior art, a document folder includes an upper sheet, a lower sheet and a folding portion which interconnects the upper and lower sheets. A generally C-shaped clamp has an upper clamping plate, a lower clamping plate and a curved portion which interconnects the upper and lower clamping plates. The free edges of the upper and lower clamping plates, which are opposed to the curved portion, clamp cooperatively the document folder adjacent to the folding portion of the document folder in order to hold securely the documents, papers, etc., which are received in the document folder. The upper clamping plate of the C-shaped member has a rectangular hole formed therein. The upper sheet of the document folder has an erected hook member integrally formed therewith and that is provided adjacent to the folding portion of the document folder. The hook member hooks into the rectangular hole of the C-shaped clamp so as to position the C-shaped clamp on the document folder. Thus, the C-shaped clamp can slide on the document in order to clamp or release the documents in the document folder. This type of document folder is convenient for holding documents, papers) etc. However, the manufacture of the hook member of the document folder is difficult and troublesome, thereby increasing the manufacturing time to increase correspondingly the manufacturing costs of the document folder.

SUMMARY OF THE INVENTION

It is therefore a main object of this invention to provide a document folder which has a clamp that is slidably retained on the document and which can be manufactured easily and economically.

Accordingly, the document folder of this invention includes an upper sheet, a lower sheet and an elongated folding portion which interconnects the upper and lower sheets. A generally C-shaped clamp has an upper clamping plate, a lower clamping plate and a curved portion which interconnects the upper and lower clamping plates. Two protrusions extend oppositely from the free edge of the lower clamping plate. Two parallel slits are formed in the lower sheet of the document folder adjacent to the folding portion of the document folder. The protrusions of the lower clamping plate of the C-shaped clamp are slidably and respectively received in the slits.

Other features and advantages of this invention will become apparent in the following detailed description of a preferred embodiment of this invention with reference to the accompanying drawings.

DETAILED DESCRIPTION OF THE PREFERRED EMBODIMENT

Figure 1:
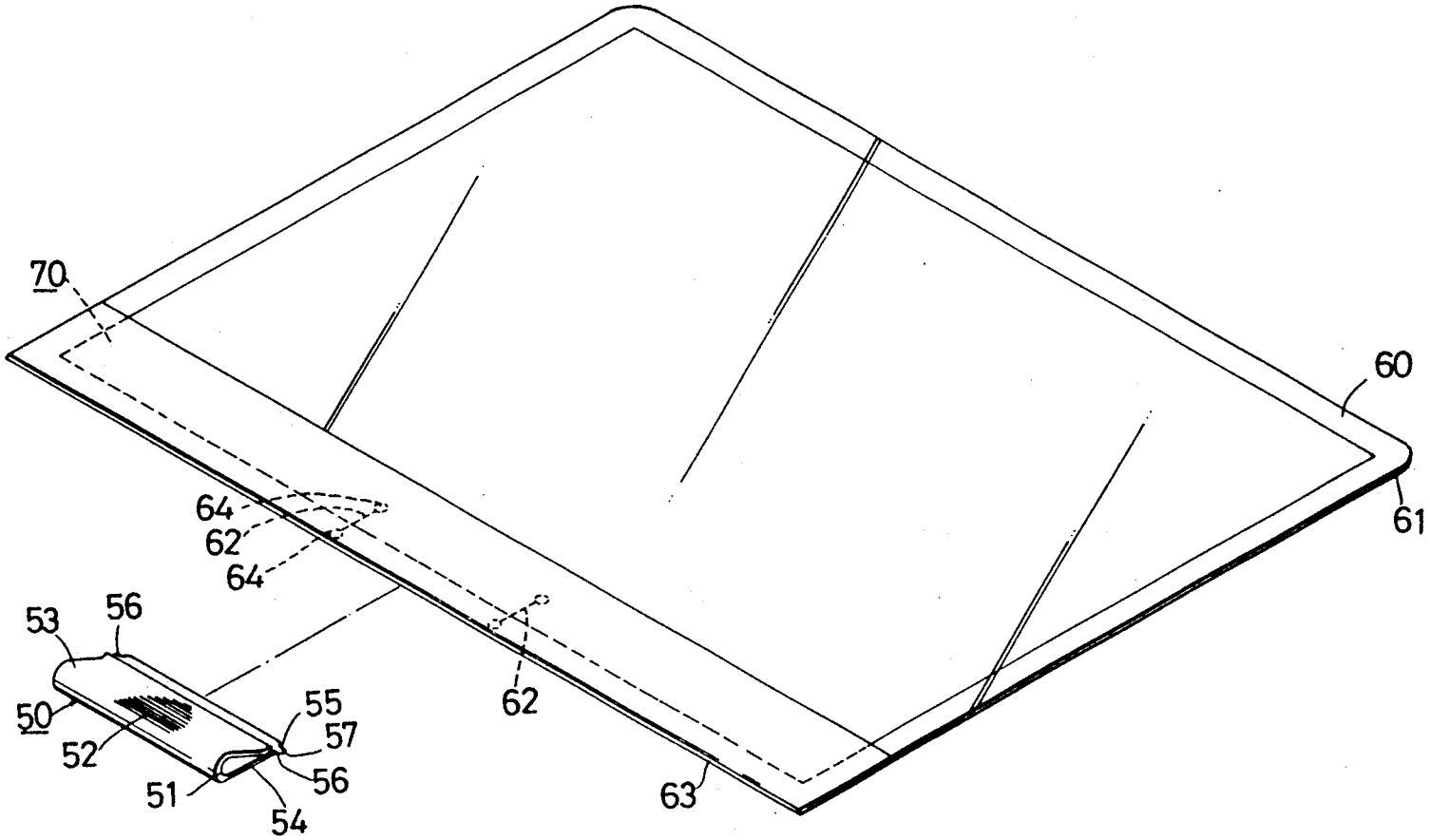
FIG. 1 is a perspective exploded view of a preferred embodiment of a document folder of this invention.
Figure 4:
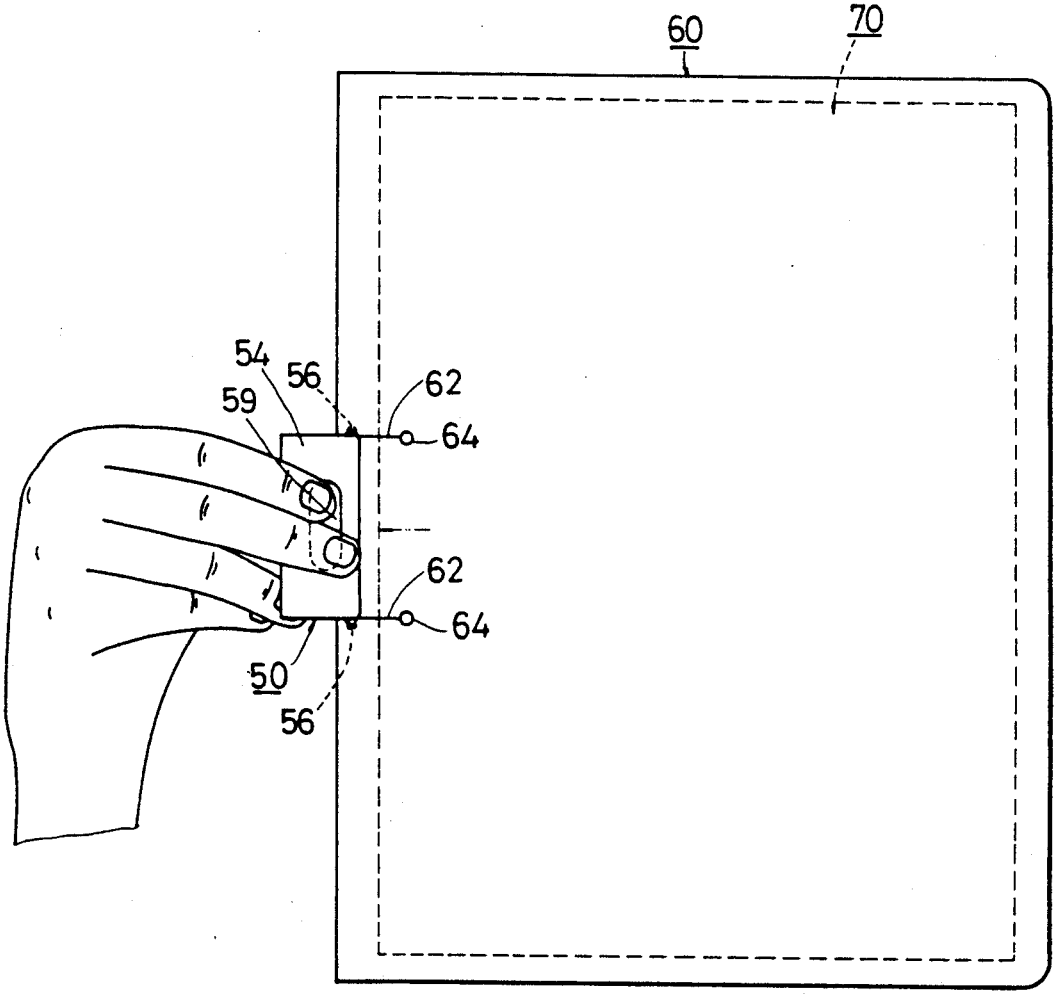
FIG. 4 is a schematic view illustrating the document folder of this invention when in use.

FIG. 1 shows a perspective exploded view of a preferred embodiment of a document folder of this invention. The document folder includes an upper sheet (60), a lower sheet (61) and an elongated folding portion (63) which extends in a first direction and which interconnects the upper and lower sheets (60, 61). The upper sheet (60) is made of a transparent plastic material. The lower sheet (61) and the folding portion (63) are made of an opaque plastic material. A generally C-shaped clamp (50) has an upper clamping plate (53), a lower clamping plate (54) and a curved portion (51) which interconnects the upper and lower clamping plates (53, 54). The C-shaped clamp (50) is made of a plastic material. The free edges of the upper and lower clamping plates (53, 54), which are opposed to the curved portion (51), clamp cooperatively the document folder adjacent to the folding portion (63) of the document folder. Two protrusions (56) extend oppositely from the free edge of the lower clamping plate (54) in a first direction. Each of the protrusions (56) is semi-circular in cross section and has a flat face (55) and a rounded face (57). The flat faces (55) of the protrusions (56) are flushed with the internal face (54) of the lower clamping plate (54). Two parallel slits (62) are formed in the lower sheet (61) of the document folder and extend in a second direction perpendicular to the first direction adjacent to the folding portion (63) of the document folder. The protrusions (56) of the lower clamping plate (54) of the C-shaped clamp (50) are slidably and respectively received in the slits (62). Therefore, the C-shaped clamp (50) can be moved in the second direction in order to clamp or release the documents (70) which are received in the document folder, as best illustrated in FIG. 4. Each of the slits (62) has two holes (64) connected respectively to the ends thereof. The holes (64) can prevent the lower sheet (61) from being torn along the slits (62) when the protrusions (56) slide in the slits (62).

Figure 2:
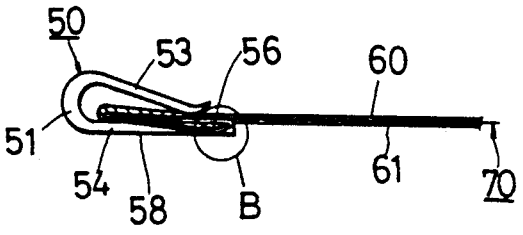
FIG. 2 is a cross sectional view of the preferred embodiment of the document folder of this invention.
Figure 3:
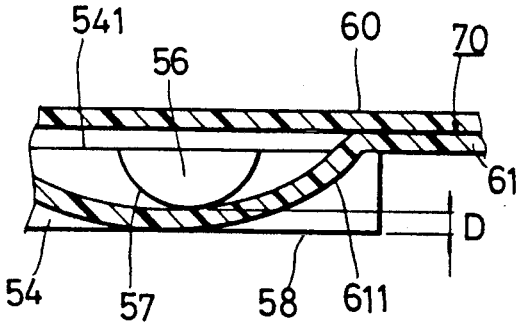
FIG. 3 is a sectional enlarged view of the circle (B) in FIG. 2.

The difference (D) of the thickness of the lower clamping plate (54) and the height of the protrusions (56) is equal to the thickness of the lower sheet (61) of the document folder, as best illustrated in FIGS. 2 and 3. In this embodiment, the difference (D) is 0.3 mm. Thus, the protrusions (56) can slide smoothly in the slits (62), and the lower face (61) of the lower sheet (61) will not be pushed so as to project beyond the external face (58) of the lower clamping plate (54).

The curved portion (51) of the C-shaped clamp (50) is thicker than the upper and lower clamping plates (53, 54) in order to increase the clamping force of the C-shaped clamp (50). In this embodiment, the thickness of the curved portion (51) is 2.5 mm, and the thickness of the upper and lower clamping plates (53, 54) is 1.5 mm.

A roughened region (52) and a recess (59) are respectively provided on the external faces of the upper and lower clamping plates (53, 54) so as to facilitate handling of the C-shaped clamp (50).

With this invention thus explained, it is apparent that numerous modifications and variations can be made without departing from the scope and spirit of this invention. It is therefore intended that this invention be limited only as indicated in the appended claims.

I CLAIM:

1. A document folder comprising an upper sheet, a lower sheet and an elongated folding portion which extends in a first direction and which interconnects said upper and lower sheets, a generally C-shaped clamp having an upper clamping plate, a lower clamping plate and a curved portion which interconnects said upper and lower clamping plates, said upper and lower clamping plates having free edges which are opposed to said curved portion and cooperatively clamping said document folder adjacent to said folding portion of said document folder, a positioning device having a first engaging member which is provided on said C-shaped clamp, and a second engaging member which is provided on document folder and which engages said first engaging member of said C-shaped clamp, the improvements comprising:

said first engaging member including two protrusions extending oppositely from said free edge of said lower clamping plate in said first direction, each of said protrusions being semi-circular in cross section with a flat face and a rounded face, said flat faces of said protrusions being flushed with the internal face of said lower clamping plate, said second engaging member including two parallel slits which are formed in said lower sheet of said document folder and which extend in a second direction perpendicularly to said first direction adjacent to said folding portion of said document folder, said protrusions of said lower clamping plate of said C-shaped clamp being slidably and respectively received in said slits.

2. A document folder as claimed in claim 1, further characterized in that each of said slits has two holes connected respectively to the ends thereof.

3. A document folder as claimed in claim 1, further characterized in that each of said protrusions has a height which is equal to the difference of the thickness of said lower clamping plate and that of said lower sheet of said document folder.

* * * * *